US005778800A

United States Patent [19]

Liang

[11] Patent Number: 5,778,800

[45] Date of Patent: Jul. 14, 1998

[54] FOLDING COLLAPSIBLE MANTEL

[76] Inventor: Chin-Chun Liang, No. 25-12, An-Ho Rd., Hsi-Tun Dist., Taichung, Taiwan

[21] Appl. No.: 832,005

[22] Filed: Apr. 2, 1997

[51] Int. Cl.[6] ..... A47B 35/00

[52] U.S. Cl. ..... 108/50.11; 108/26

[58] Field of Search ..... 108/50, 24, 25, 108/26, 50.11; 126/25 R, 29, 30, 9 R, 11, 275 R

[56] References Cited

U.S. PATENT DOCUMENTS

| | | | |
|---|---|---|---|
| 1,464,889 | 8/1923 | Stirn | 108/50 X |
| 4,840,128 | 6/1989 | McFarlane et al. | 108/50 |
| 5,060,580 | 10/1991 | Shaw | 108/25 |
| 5,168,796 | 12/1992 | Porton et al. | 108/50 X |

FOREIGN PATENT DOCUMENTS

| | | | |
|---|---|---|---|
| 6086715 | 3/1994 | Japan | 108/50 |

*Primary Examiner*—Jose V. Chen

*Attorney, Agent, or Firm*—Morton J. Rosenberg; David I. Klein; Jun Y. Lee

[57] ABSTRACT

A folding collapsible mantel including a folding table plate formed of two table tops hinged together and equipped with two pairs of folding stands, the table plate having a center opening and mounting grooves at two opposite sides of its center opening, a base open mounting frame detachably suspended from the center opening of the table plate, a peripherally perforated suspension open mounting frame detachably suspended from the base open mounting frame, and a peripherally perforated case detachably suspended from the suspension open mounting frame for carrying a fuel for burning.

4 Claims, 7 Drawing Sheets

FOLDING COLLAPSIBLE MANTEL

BACKGROUND OF THE INVENTION

The present invention relates to a mantel, and more particularly to a folding collapsible mantel which can be alternatively arranged into a table when it is not to be used for cooking food.

Regular mantels either designed for burning a fuel gas or coal, are commonly made of fixed structure that is not collapsible. Further, when using a mantel to cook foods outdoors, a table or the like shall be used for carrying foods, etc. It is inconvenient to carry mantel and a table when going to the outside for a picnic or an outdoor activity.

SUMMARY OF THE INVENTION

It is one object of the present invention to provide a mantel which is folding collapsible. It is another object of the present invention to provide a folding collapsible mantel which can be conveniently set into the form of a table for cooking food at its top center. It is still another object of the present invention to provide a folding collapsible mantel which can be conveniently carried by hand when collapsed. According to the present invention, the folding collapsible mantel comprises a folding table plate formed of two table tops hinged together, each table top having a notch at one side, a reinforcing rib raised from a bottom side around the border and defining a bottom open chamber, and two mounting grooves formed at said reinforcing ribs and disposed at two opposite sides in said notch, the notches of the table tops forming an opening at the center of the folding table plate; two pairs of folding stands respectively pivoted to the table tops; two pairs of folding braces respectively connected between the table tops and the folding stands; a base open mounting frame adapted to be mounted in the center opening of the table plate, the base open mounting frame comprising an outward top flange raised around the periphery of a top side thereof and mounted in the mounting grooves of the table tops, a center opening, and an inward bottom flange raised from a bottom side thereof around its center opening; a suspension open mounting frame mounted in the center opening of the base open mounting frame, having a plurality of air vents spaced around the periphery outside the base open mounting frame, a center opening, an outward top flange supported on the inward bottom flange of the base open mounting frame, and an inward bottom flange raised from a bottom side thereof around its center opening; and a case mounted in the center opening of the suspension open mounting frame and adapted for carrying a fuel for burning, having a plurality of air vents spaced around the periphery outside the suspension open mounting frame, and an outward top flange supported on the inward bottom flange of the suspension open mounting frame. According to another aspect of the present invention, each table top is equipped with a handle for carrying by hand.

DETAILED DESCRIPTION OF THE PREFERRED EMBODIMENT

Figure 1:
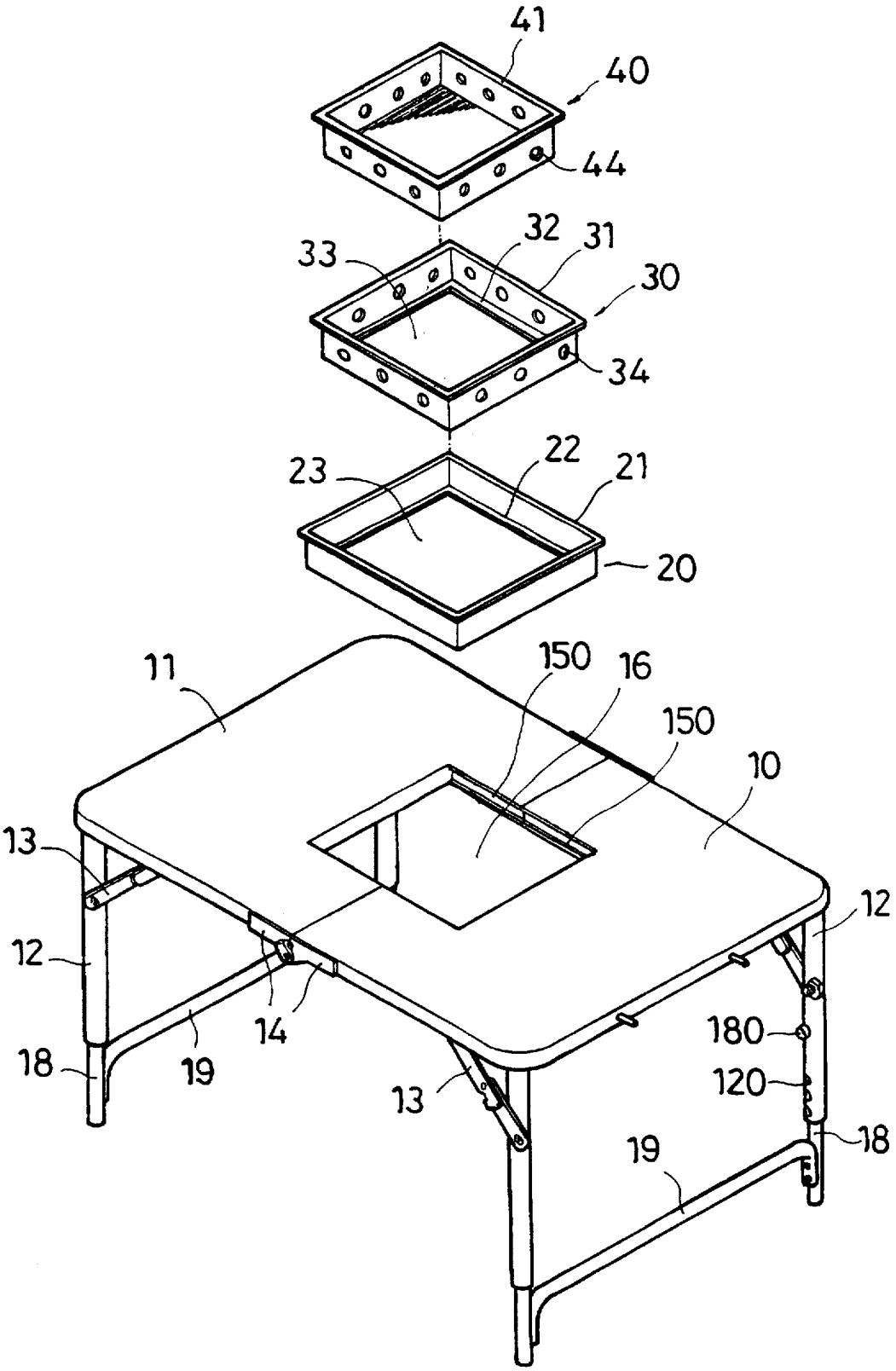
FIG. 1 is an exploded view of a folding collapsible mantel according to the present invention.
Figure 2:
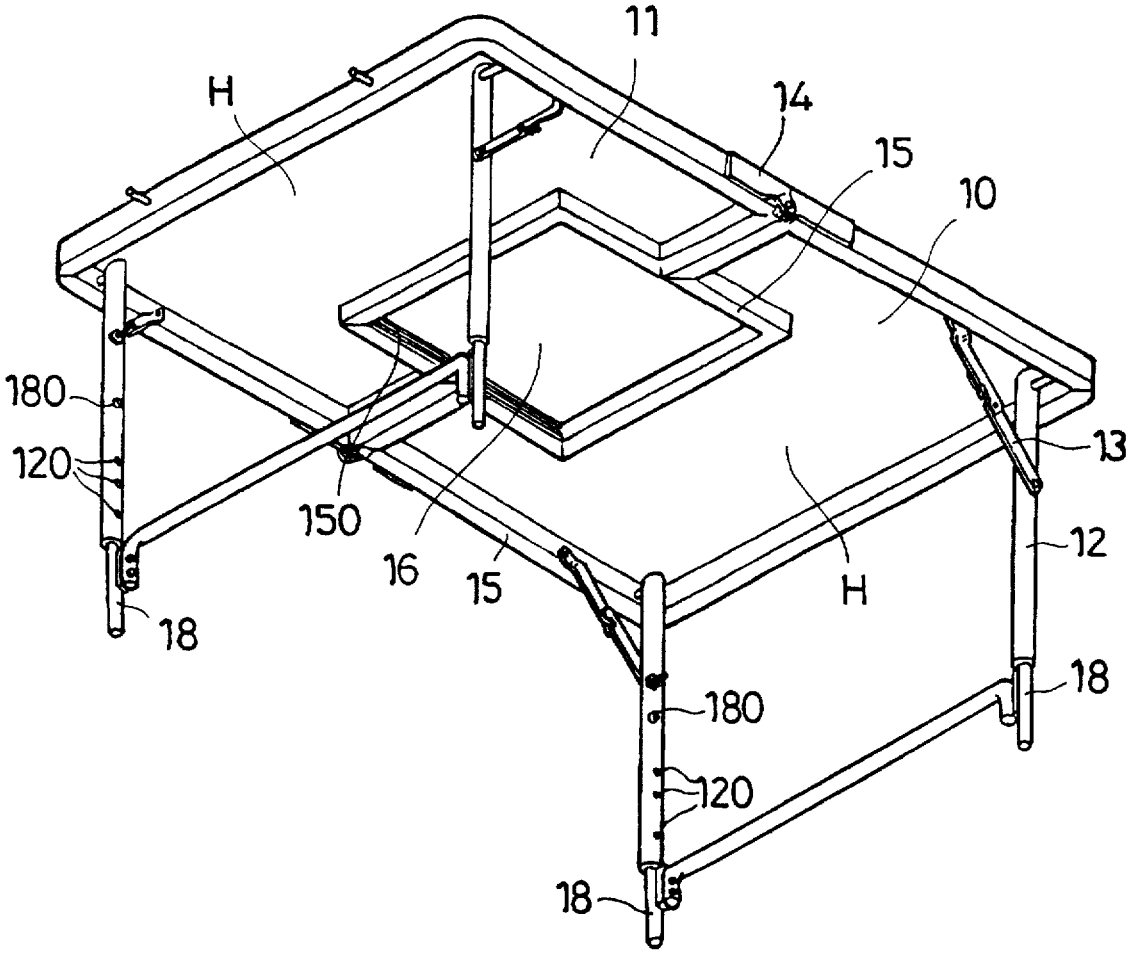
FIG. 2 is a perspective bottom view of the folding collapsible mantel shown in FIG. 1.
Figure 3:
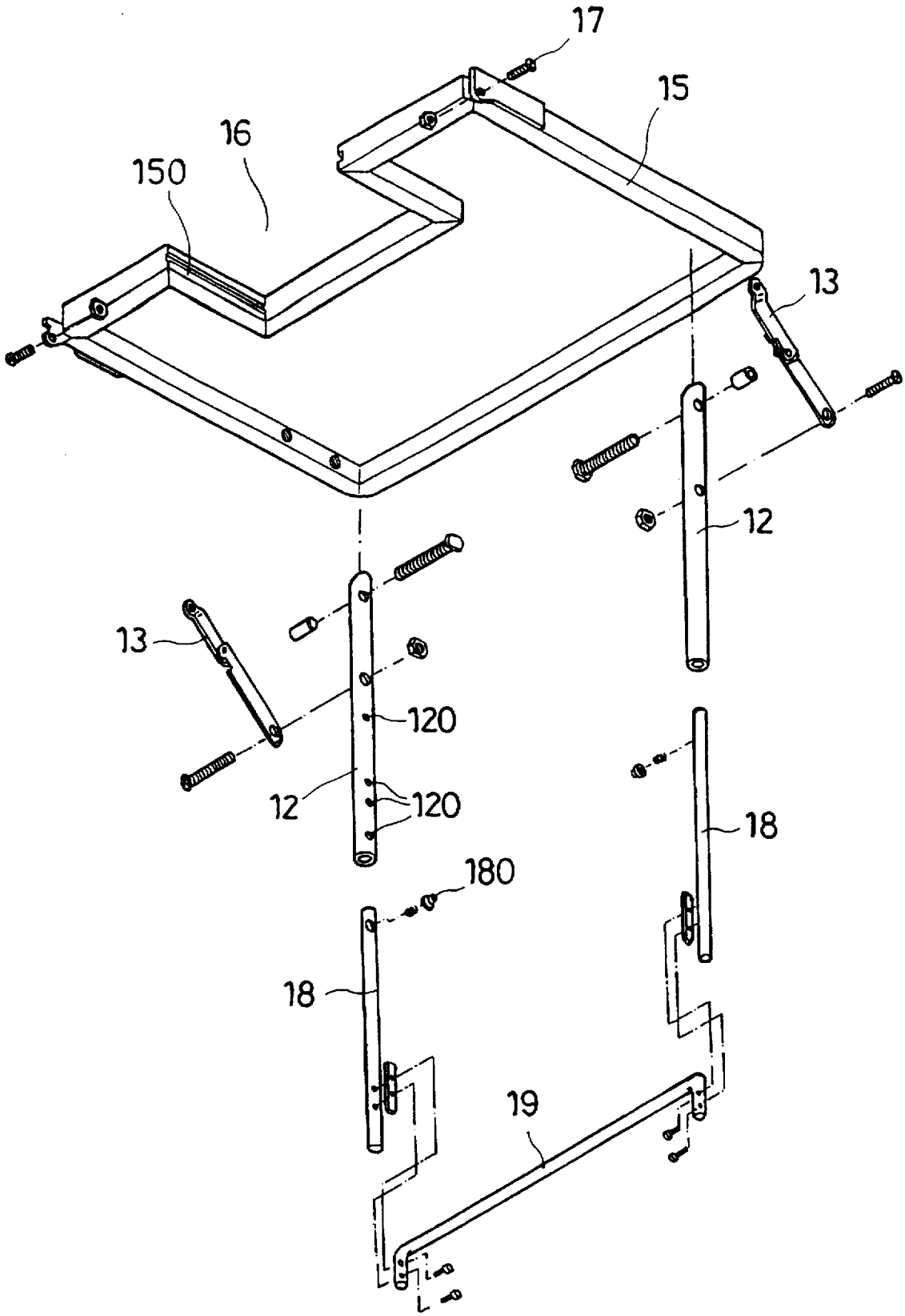
FIG. 3 is an exploded view of the right half of the folding collapsible mantel shown in FIG. 1.

Referring to FIGS. 1, 2 and 3, two table tops 10;11 are hinged together by hinges 14 and screws 17, and equipped with a respective pair of stand tubes 12 and a respective pair of extension legs 18 moved in an out of the stand tubes 12. Each stand tube 12 has a longitudinal series of locating holes 120. Each extension leg 18 is mounted with a spring-supported retainer 180 adapted to engage one of the series of locating holes 120 of the corresponding stand tube 18. Folding braces 13 are respectively connected between the table tops 10;11 and the stand tubes 12. A stretcher 19 is connected between each pair of extension legs 18.

Figure 4:
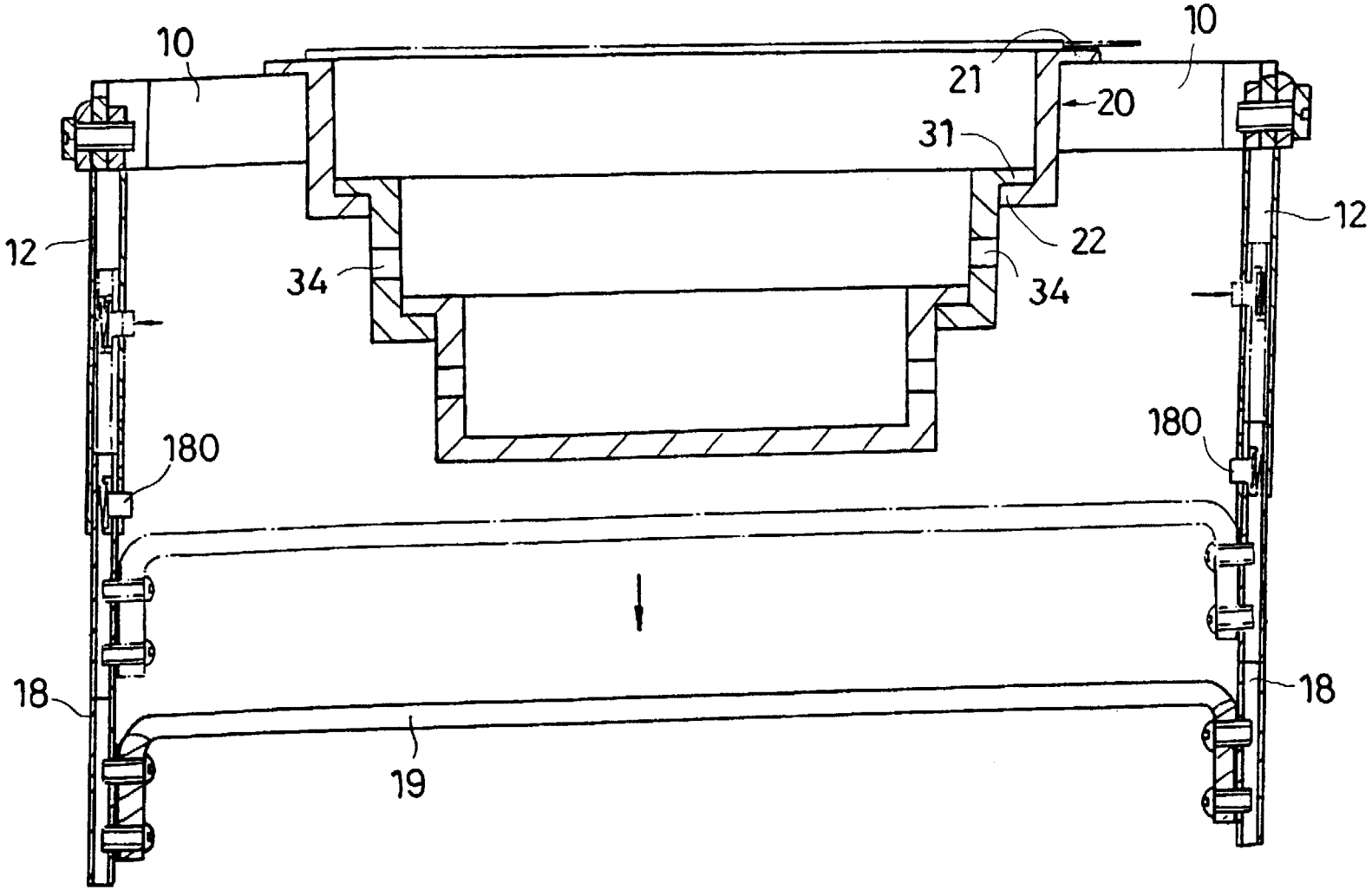
FIG. 4 is a side view in section in an enlarged scale of the present invention, showing the folding collapsible mantel set into the operative condition.
Figure 5:
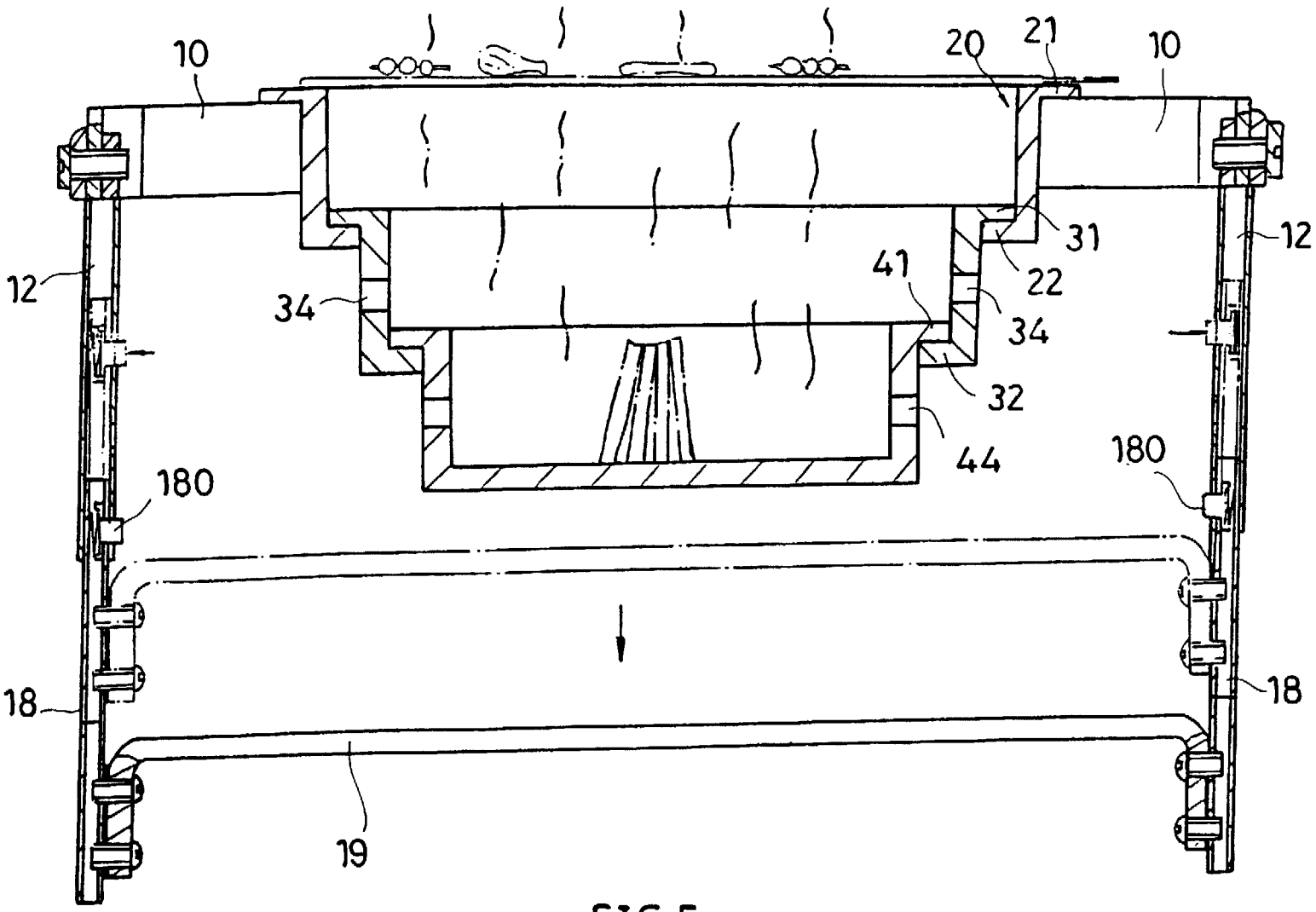
FIG. 5 is an applied view of the present, showing a fuel burned in the case, and food cooked.

Referring to FIG. 4 and FIGS. from 1 to 3 again, the table tops 10;11 have a respective notch at an inner side matched together to form a center opening 16 at the center of the folding table plate (the table tops 10;11 form a folding table plate), a respective reinforcing rib 15 raised from the bottom side along the border and defining a respective bottom chamber H, and a respective pair of mounting grooves 150 bilaterally formed at the respective reinforcing rib 15 within the center opening 16. A base open mounting frame 20 is adapted to be mounted within the center opening 16 to hold a suspension open mounting frame 30 on the inside and a case 40 within the suspension open mounting frame 30. The base open mounting frame 20 comprises an outward top flange 21 raised around the periphery of its top side, a center opening 23, and an inward bottom flange 22 raised from its bottom side around the center opening 23. When the base open mounting frame 20 is put in the center opening 16 of the table plate 10;11, the outward top flange 21 is forced into engagement with the mounting grooves 150 of the table plate 10;11. The suspension open mounting frame 30 is mounted in the center opening 23 of the base open mounting frame 20 and suspended from its bottom side, having a plurality of air vents 34 spaced around the periphery outside the base open mounting frame 20, a center opening 33, an outward top flange 31 supported on the inward bottom flange 22 of the base open mounting frame 20, and an inward bottom flange 32 raised from the bottom side around the center opening 33. The case 40 is mounted in the center opening 33 of the suspension open mounting frame 30, having a plurality of air vents 44 spaced around the periphery outside the suspension open mounting frame 30, and an outward top flange 41 supported on the inward bottom flange 32 of the suspension open mounting frame 30.

When the folding collapsible mantel is assembled, the table tops 10;11 are extended out, then the stand tubes 12 are respectively extended out, and then the elevation of the extension legs 18 is adjusted by: forcing the spring-supported retainer 180 inwards from the locating holes 120 of each stand tube 12 and then moving the respective extension leg 18 in the respective stand tube 12 to the desired elevation for permitting the respective spring-supported retainer 180 to be forced into the designated locating hole 120, and then the base open mounting frame 20 is put in the center opening 16 of the table plate 10;11 to hold the suspension open mounting frame 30 and the case 40, and therefore the whole assembly is set in the operative condition shaped like a table (see FIG. 4). When set up, fuel for example coal or wood is put in the case 40 and burned for cooking food.

Figure 6:
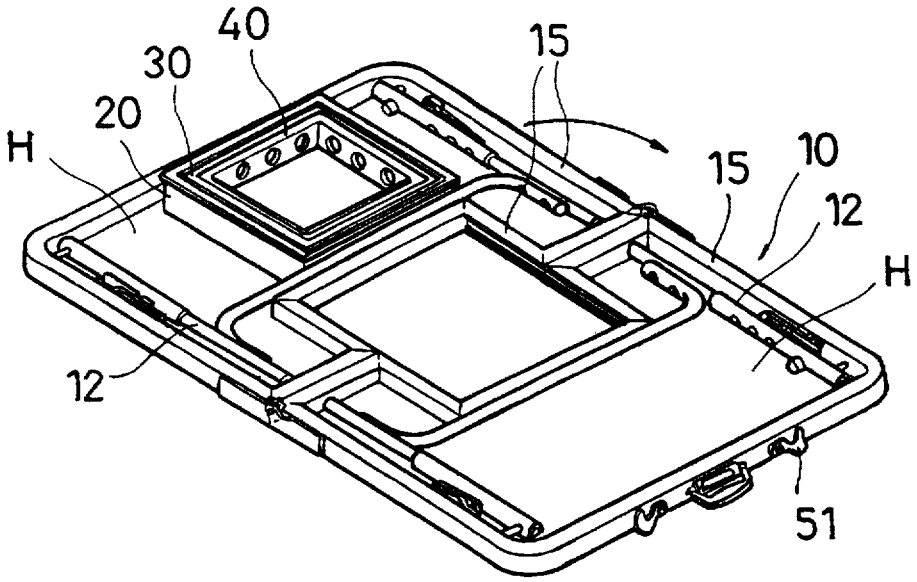
FIG. 6 shows the collapsing procedure of the present invention.
Figure 6:
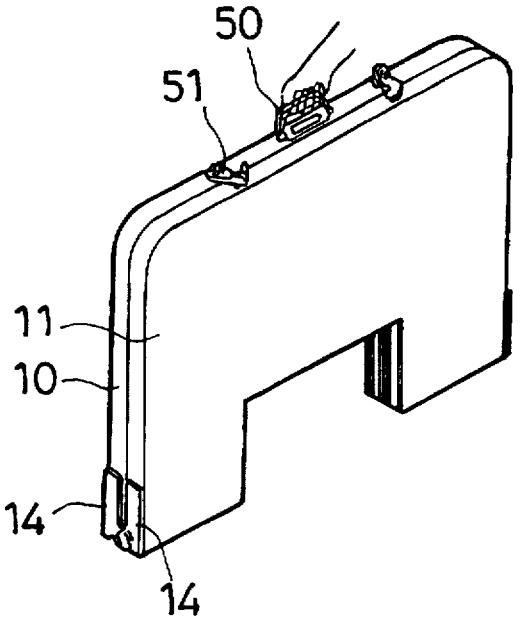

Referring to FIG. 6, when not in use, the base open mounting frame 20 with the suspension open mounting frame 30 and the case 40 are taken out of the center opening 16 of the table plate 10;11, then stand tubes 12 are folded up and closely attached to the table tops 10;11 at the bottom side, and then the base open mounting frame 20 with the suspension open mounting frame 30 and the case 40 are put in the bottom chamber H of one table top 10, and then the table tops 10;11 are folded up to hold the base open mounting frame 20 and the suspension open mounting frame 30 and the case 40 on the inside.

Figure 7:
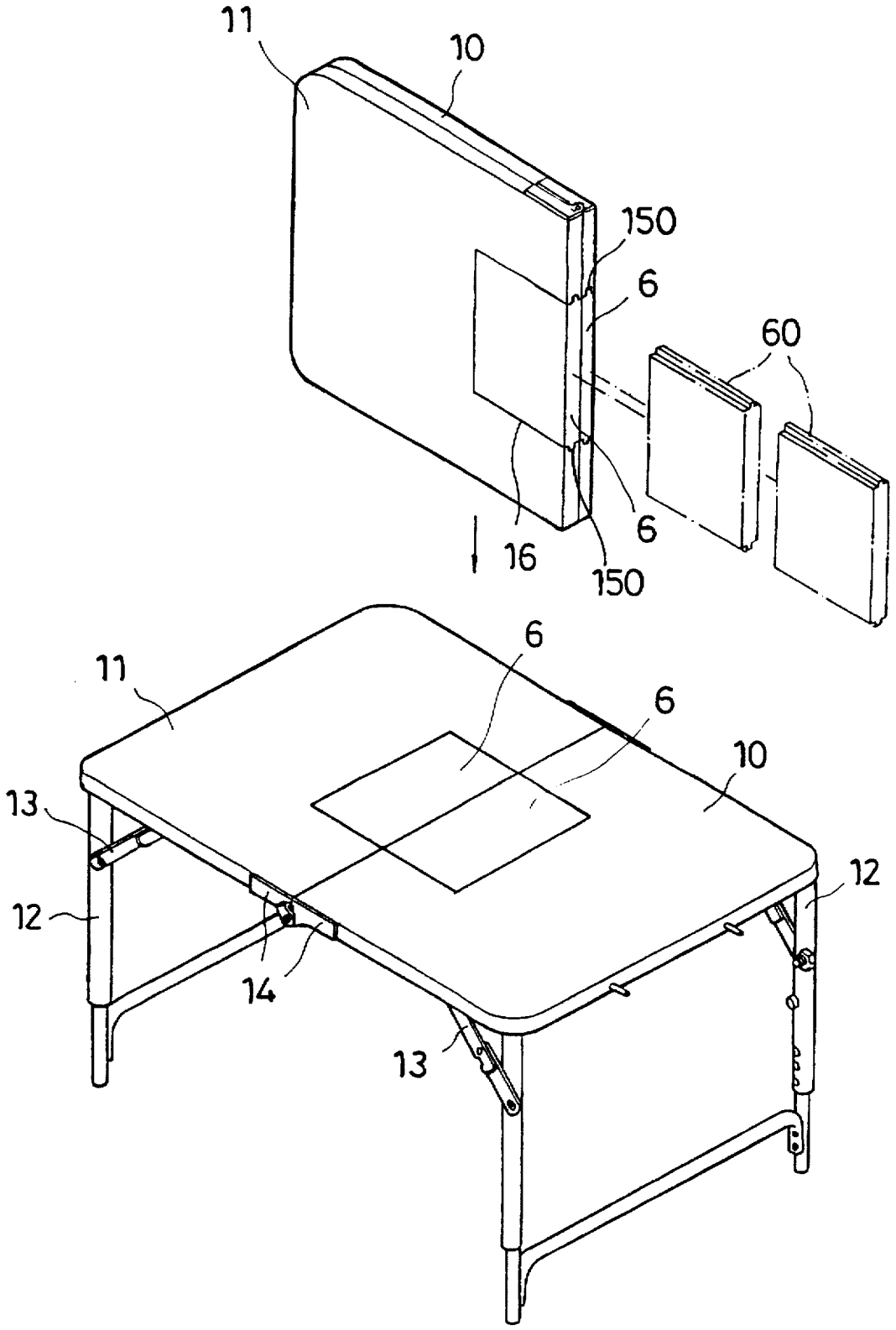
FIG. 7 shows the installation of two insertion blocks in the notches of the table tops according to the present invention.

Referring to FIG. 7, two insertion blocks 6 are provided and adapted to be inserted into the notches of the table tops 10;11 to fill up the center opening 16. Each insertion block 6 has two side flanges 60 raised from two opposite sides and adapted to be forced into engagement with the mounting grooves 150 of the table tops 10;11. When the insertion blocks 6 are installed, the center opening 16 is filled up, and the insertion blocks 6 are disposed in flush with the top surface of the table plate 10;11.

It is to be understood that the drawings are designed for purposes of illustration only, and arc not intended as a definition of the limits and scope of the invention disclosed. For example, the table tops 10;11 may be equipped with a respective handle for carrying by hand.

What the invention claimed is:

1. A folding collapsible mantel comprising:

a folding table plate formed of two table tops hinged together, each table top having a notch at one side, a reinforcing rib raised from a bottom side around a border of the notch and defining a bottom open chamber, and two mounting grooves formed in said reinforcing ribs and disposed at two opposite sides in said notches, the notches of said table tops forming a first opening at the center of said folding table plate;

two pairs of folding stand respectively pivoted to said table tops;

two pairs of folding braces respectively connected between said table tops and said folding stands;

a base open mounting frame adapted to be mounted in the first opening of said table plate, said base open mounting frame comprising an outward top flange raised around a periphery of a top side thereof and mounted in the mounting grooves of said table tops, a second center opening, and an inward bottom flange raised from a bottom side thereof around said second opening;

a suspension open mounting frame mounted in the second center opening of said base open mounting frame, having a plurality of air vents spaced around an outside periphery of said base open mounting frame, a third center opening, an outward top flange supported on the inward bottom flange of said base open mounting frame, and an inward bottom flange raised from a bottom side thereof around said third center opening; and a case mounted in the third center opening of said suspension open mounting frame and adapted for carrying a fuel for burning, having a plurality of air vents spaced around an outside periphery of said suspension open mounting frame, and an outward top flange supported on the inward bottom flange of said suspension open mounting frame.

2. The folding collapsible mantel of claim 1 wherein said table tops are equipped with a respective carrying handle.

3. The folding collapsible mantel of claim 1 further comprising two insertion blocks adapted to be mounted in the mounting grooves of said table tops to fill up said notch in a flush manner.

4. The folding collapsible mantel of claim 1 wherein each of said folding stands comprises a stand tube pivoted to one table top and having a longitudinal series of locating holes, and an extension leg moved in said stand tube and equipped with a spring-supported retainer adapted to engage one of said locating holes.

* * * * *